United States Patent [19]

Gugger et al.

[11] 4,393,944

[45] Jul. 19, 1983

[54] DRILL RIG

[75] Inventors: Hans Gugger; John Ackland, both of Brisbane, Australia

[73] Assignee: Warman International Limited, Australia

[21] Appl. No.: 186,298

[22] Filed: Sep. 11, 1980

[30] Foreign Application Priority Data

Sep. 18, 1979 [AU] Australia ..... PE0543

[51] Int. Cl.[3] ..... E21B 7/02; E21B 15/04

[52] U.S. Cl. ..... 173/28; 173/44; 173/163; 173/164; 175/85

[58] Field of Search ..... 173/22, 28, 43, 44, 173/163, 164, 165, 39; 166/77.5; 175/85, 52; 248/647, 652

[56] References Cited

U.S. PATENT DOCUMENTS

| | | | |
|---|---|---|---|
| 2,179,316 | 11/1939 | Anderson | 173/22 X |
| 2,194,066 | 3/1940 | Caldwell | 173/28 X |
| 2,803,434 | 8/1957 | Heinish | 175/85 X |
| 3,158,213 | 11/1964 | O'Neil et al. | 175/85 |
| 3,205,627 | 9/1965 | Gyongyosi | 173/44 X |
| 3,438,450 | 4/1969 | Failing | 173/44 |
| 3,576,218 | 4/1971 | Lisenby | 173/28 |
| 3,708,024 | 1/1973 | Back | 173/28 X |
| 3,766,991 | 10/1973 | Brown | 173/164 X |
| 3,815,690 | 6/1974 | Cooper | 173/28 X |
| 4,126,193 | 11/1978 | Brown et al. | 173/28 X |

*Primary Examiner*—James L. Jones, Jr.
*Assistant Examiner*—Robert P. Olszewski
*Attorney, Agent, or Firm*—Townsend and Townsend

[57] ABSTRACT

The invention relates to a mobile drilling rig providing a rotation head which is small enough to fit between the mast members of the rig. Arrangements are made to pivot back the rotation head to give access to the drill line of the rig. The mast members can be pivotted on a frame to place them into the drilling and travelling position respectively.

5 Claims, 12 Drawing Figures

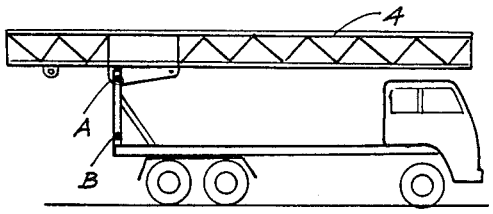
FIG. 1A
FIG. 1B
FIG. 1C
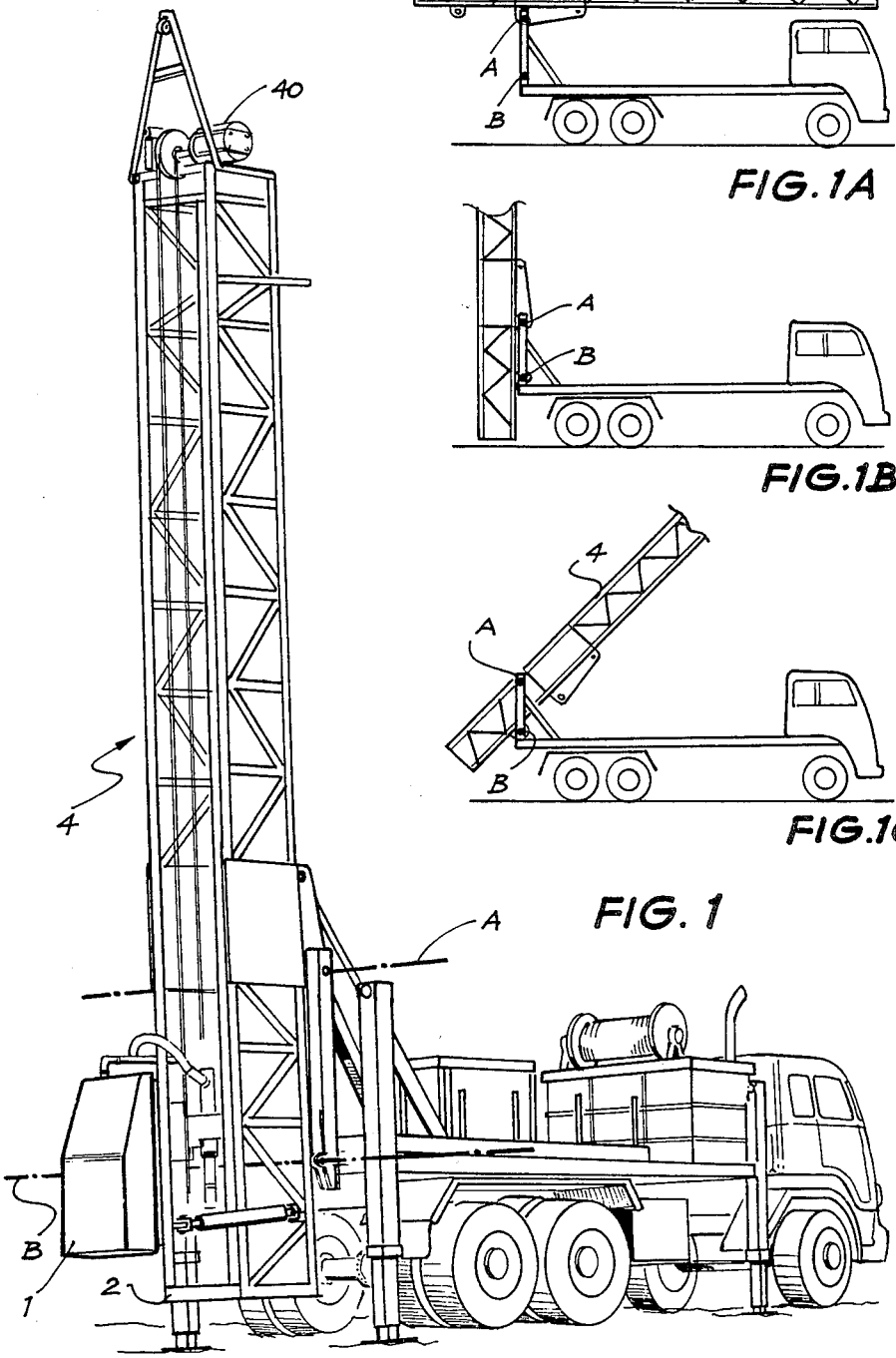
FIG. 1

DRILL RIG

The present invention relates to a drilling rig and in particular to a portable drilling rig capable of utilising a variety of techniques including rotary, down the hole hammer, angle and diamond drilling.

In conventional drilling rigs the rotation head which is supported between the two masts is rather bulky and extends well beyond the confines of the mast. In these rigs the drill line of the shaft usually does not occur between the masts and as such the base has to be strengthened and elongated beyond the mast area to strengthen against any bending motion. Further when it is required to remove the piping from the borehole by the main winch the rotation head has to be swung outside the mast to allow for the aligning of the winch rope with the drilling rod.

The present invention overcomes these problems by providing a rotation head which is small enough to fit between the mast and which can be racked back further between the masts so as to allow for a direct access of the main hoist to the drilling rod. The smallness of the motor supported directly between the mast allows for the drill line of the shaft to be between the forward members of the mast and as such there is no necessity to strengthen the base as there is in the case when the drill line is not directly between the shafts.

In one broad form the invention comprises:

a mast having a pair of forward and rearward mast members connected to each other;

a base frame located at the lower extremities of said mast members; and a rotation head comprising a variable speed axial piston motor, a planetary drive with manual shift from high to low connected to the output of said piston motor, and a main gear box connected to the output of the main gear box; said rotation head being mounted directly between the masts with the drill line located between the pair of forward mast members, and adapted to be pivotted back between the mast members to move the rotation head clear of the drill line.

This invention and its features and additional advantages will now be described with reference to the accompanying drawings in which:

FIG. 1 is an illustration of a mobile drilling rig according to one embodiment of the present invention set up in its drilling position;

FIG. 1A is a schematic of a mobile drilling rig according to one embodiment of the present invention in its transportation position;

FIG. 1B is a schematic of the embodiment of FIG. 1A in position for vertical drilling;

FIG. 1C is a schematic of FIG. 1A set up for angle drilling;

Figure 2:
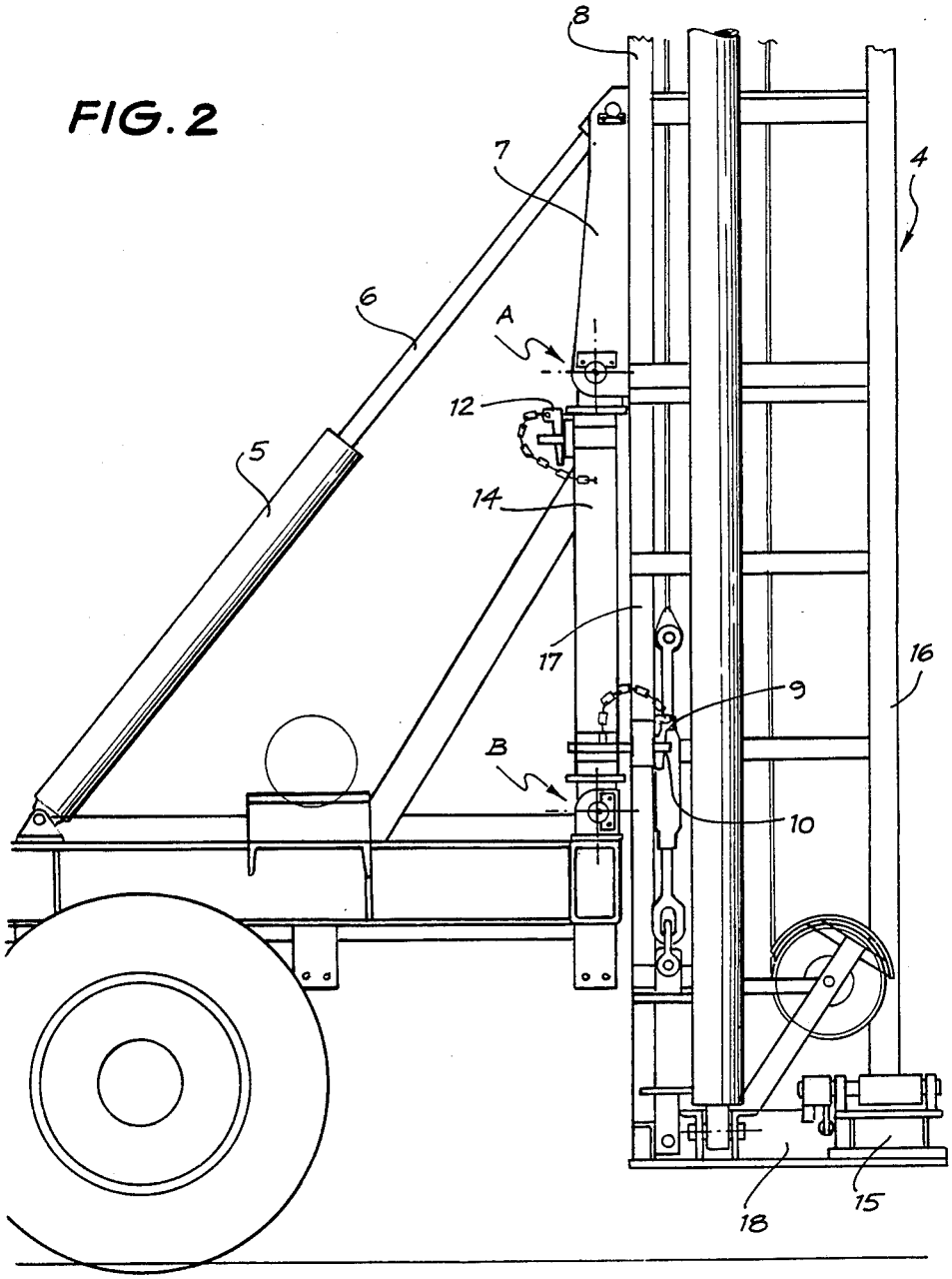
FIG. 2 is a side view of the mast pivot assembly of the embodiment of FIG. 1.
Figure 3:
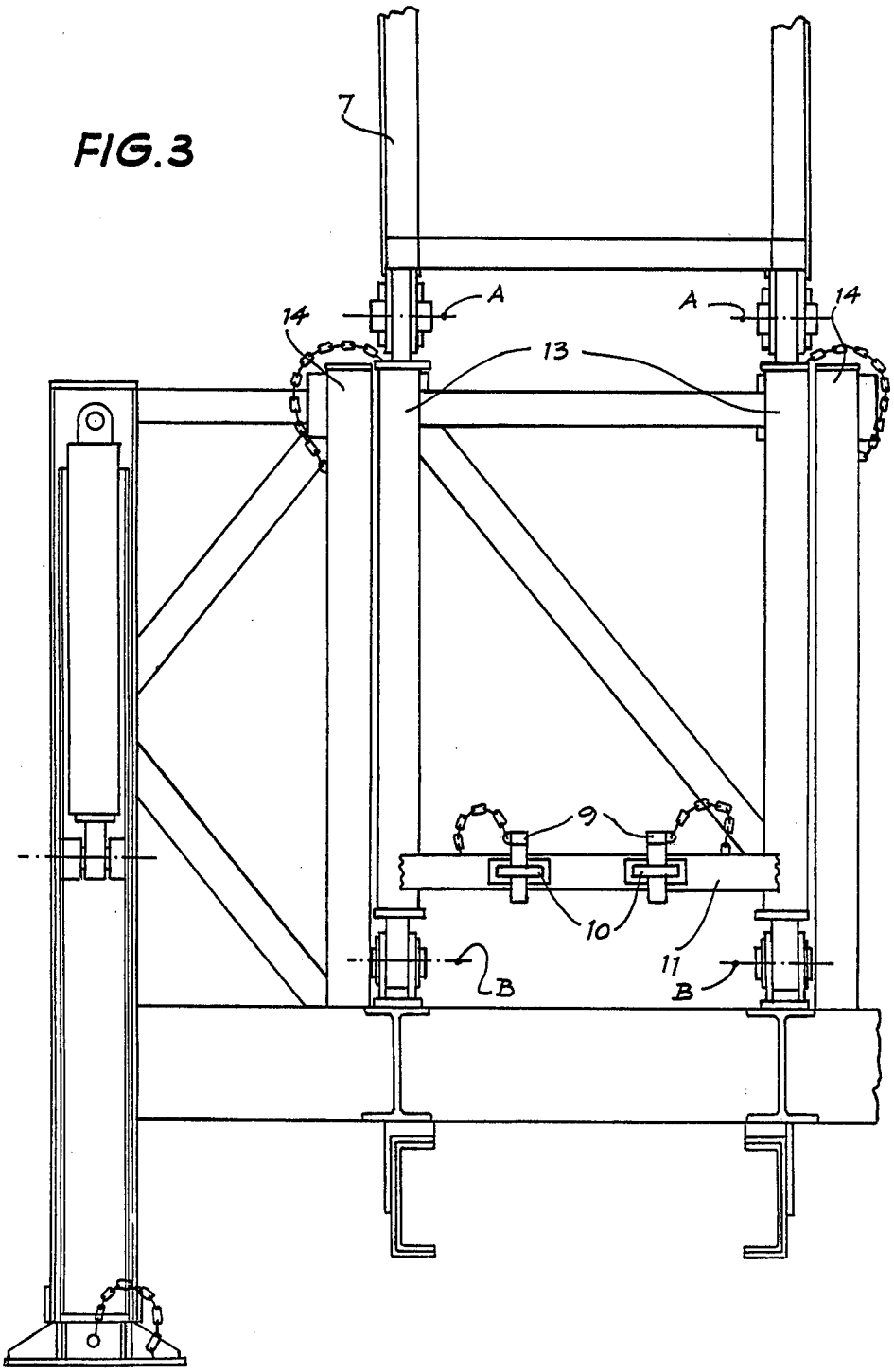
FIG. 3 is a view of the support means for the rear set of mast members showing the pivot assembly of the embodiment of FIG. 1 with the mast removed for clarity.

When drilling it is desirable to keep to a minimum the distance between the controls 1 and the working platform 2 of the mast bottom and ground level to provide ease of operation for operators. The embodiment of the present invention as shown in FIGS. 1, 2 and 3 is provided with two pivot points A and B for the mast 4 so as to produce a separate mast pivot for its travelling position and its angle drilling position.

When the mast is in its travelling position the mast is pivotted around the pivot point A such that the mast is in a horizontal position relative to the ground (FIG. 1A). The mast 4 is raised to its drilling position by two hydraulic cylinders 5 (FIG. 2). The rig can be operated in either a vertical mode as shown in FIG. 1B or an angle drilling mode as shown in FIG. 1C.

To lock the mast 4 into vertical drilling mode the hydraulic cylinders 5 extend their rams 6 which are connected to the brackets 7 on the rearward mast member 8, pivoting the mast 4 about the axis A. When the mast 4 is in the vertical position as shown in FIGS. 2 and 3 the bottom wedges 9 are inserted into the openings of the projections 10 which protrude through openings in a crossmember 11 which link the rear pair of mast members.

To return the mast to travel position the wedges 9 are removed allowing the support bracket 7 and the mast 4 to pivot about axis A.

When angle drilling, the mast is first raised into the vertical position and bottom wedges 9 are inserted. The upper wedges 12 are removed freeing the frame 13 from the fixed frame 14, such that the frame 13 and hence the mast 4 can pivot about the axis B to the angle drilling position as shown in FIG. 1C. The mast is lowered to the desired angle by the hydraulic cylinder 5. Thus, this allows the base of the mast and hence the controls and the clamping mechanism to be kept as close to the ground as possible.

To return the mast to the travelling position the mast is raised to the vertical position and wedges 12 are reinserted and wedges 9 removed allowing the mast to pivot about axis A.

As shown in FIG. 2 base frame 15 is located between the mast front main support members 16 to transfer the load of the drill string from the centre of the mast base frame 15 out to between the two front main members 16 of the mast structure. Therefore no additional stiffening of the mast bottom plate 18 is required and as such the overall mast length can be kept to a minimum.

The base frame 15 acts as a support and a guide for the clamps used in diamond drilling and for the support of the slips table used in down the hole hammer drilling.

Figure 4:
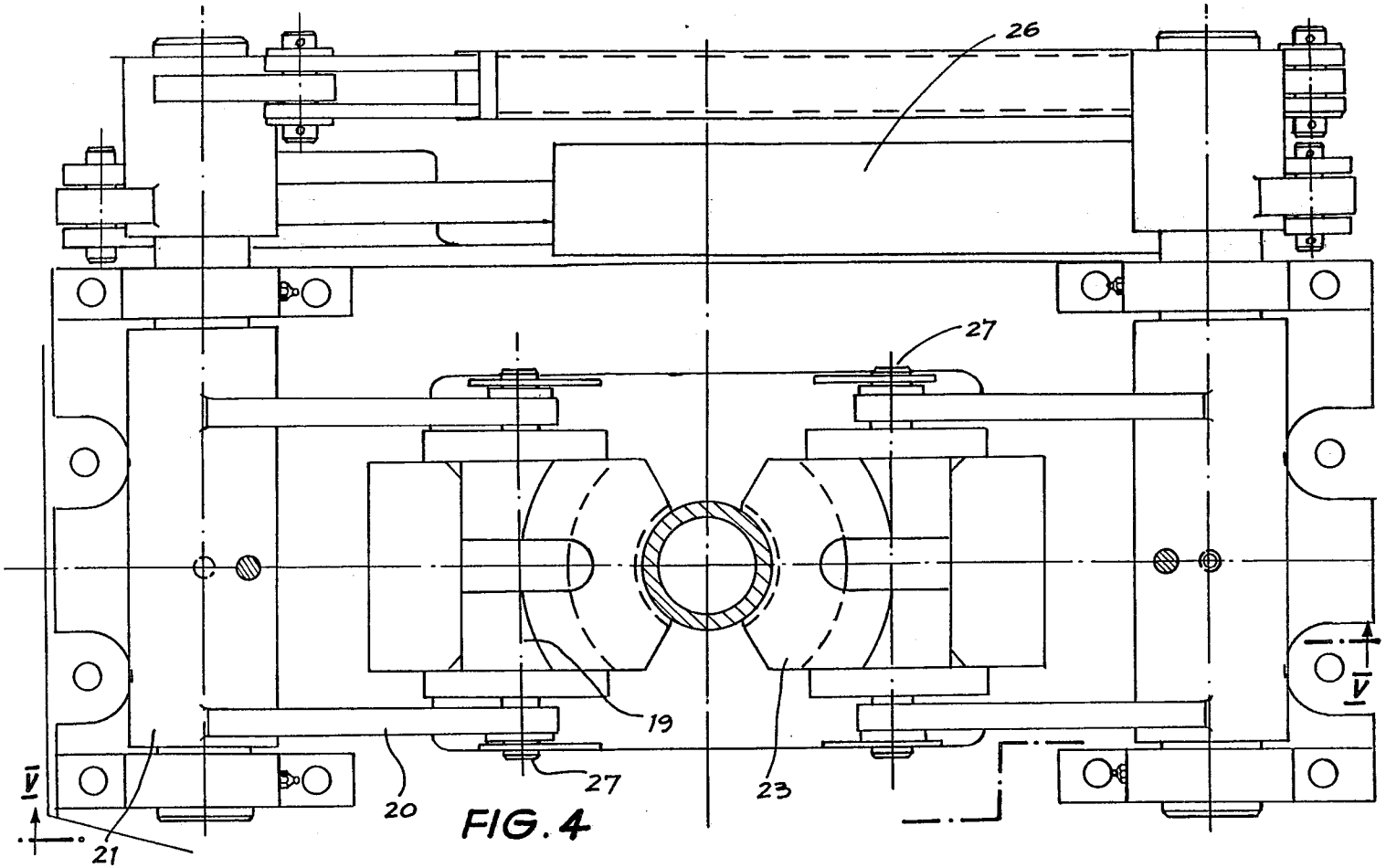
FIG. 4 is a plan view of the pipe clamping mechanism for diamond drilling according to one embodiment of the present invention.
Figure 5:
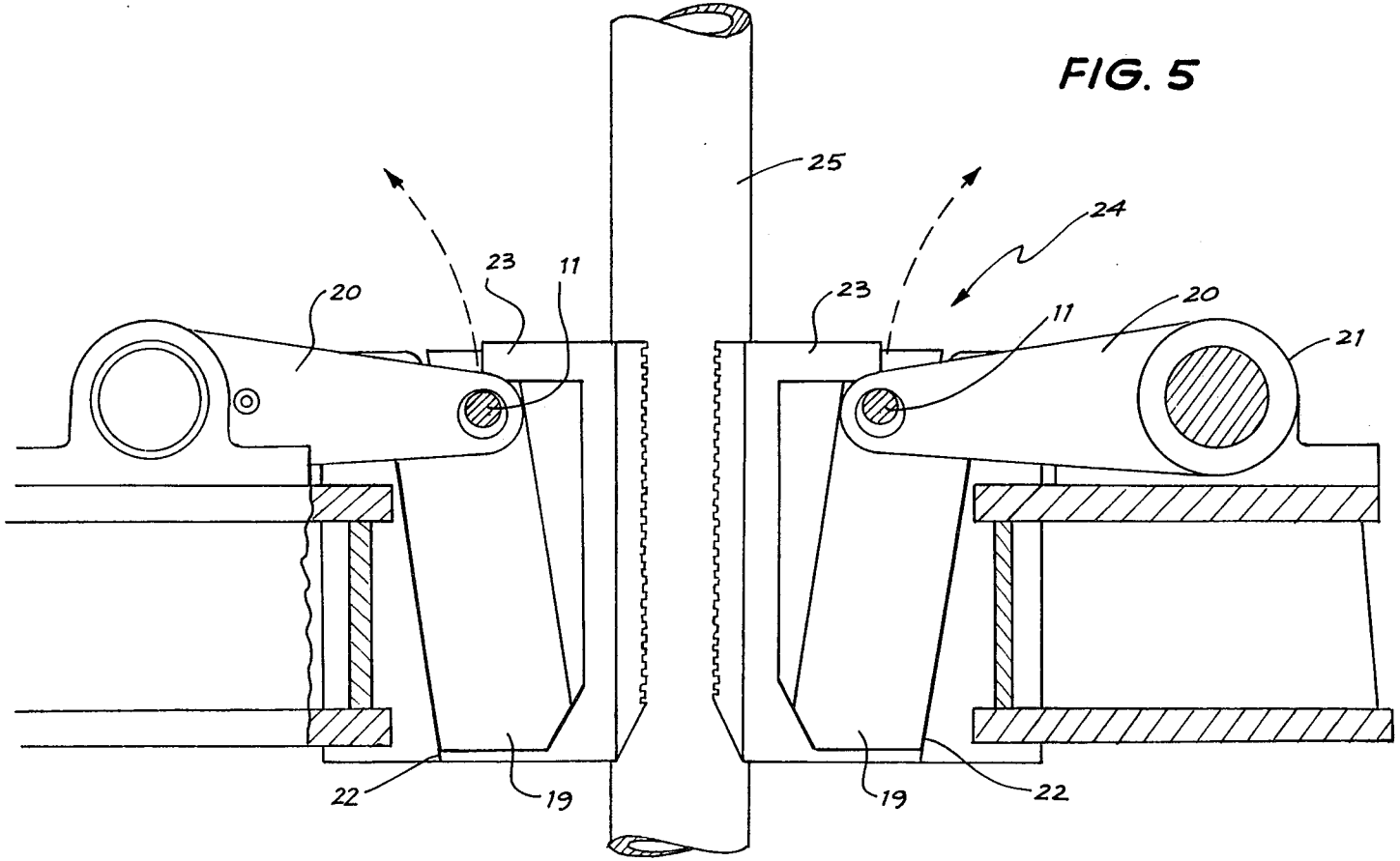
FIG. 5 is a part cross sectional view of the mechanism of FIG. 4 taking the direction of the arrows V in FIG. 4.

The clamping mechanism as used in diamond drilling techniques is that shown in FIGS. 4 and 5. A jaw holder assembly 24 is pivotally connected to lever arms 20 of the jaw lever pin 21, the jaw holder 19 riding in contact against the sloping surface 22 of the base frame 15. Jaws 23 are held in the jaw holder 19 such that the gripping surfaces of the jaws 23 are parallel to the axis of the drill shaft.

Hydraulic positively locking action is applied by the hydraulic cylinder 26 which applies a continuous force of 5,000 pounds in the closed position. The hydraulic cylinder 26 being used to close and open the clamp jaws 23. The length of the jaws is changed such that the jaws never squeeze the rods to the extent that they are permanently damaged or bent.

This sloping engagement between the base frame 15 and the jaw holder 19 provides a self-energizing clamping force which forces the jaws 23 together in direct proportion to the weight of the rod string, e.g. the heavier the weight of the rods the greater the self-energizing clamping force. Once the drill rods make contact with the jaws 23 the weight of the rods pull the jaws 23 into the wedge shaped taper formed by the sloping surface 22 of the base frame 15. This taper is precisely calculated to most effectively use the rod weight for clamping, the jaws become in effect, entirely independent from the clamping effect of the hydraulic cylinder 26, as well as from the effect of any of the lever arms 20 of the clamp body which raise or lower the jaws. In short, once locked the clamps cannot be opened until the winch lifts the load and so releases the self-energizing clamping force.

To open the clamps the hydraulic cylinder rotates the jaw lever pin, 21 which pivots the levers 20 in the direction of the arrows shown in FIG. 5 and the drill shaft can be removed.

Figure 6:
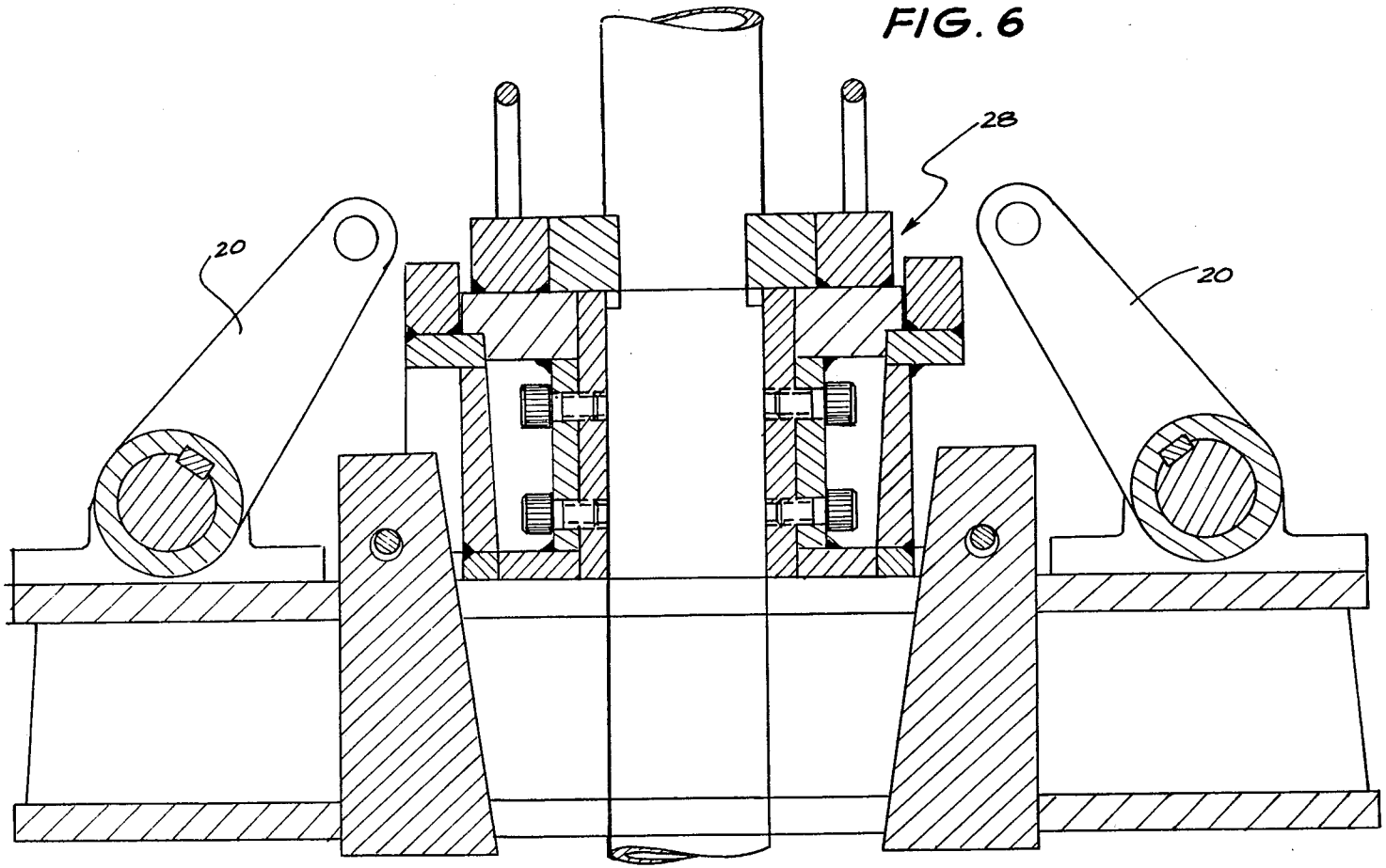
FIG. 6 is a similar view to that of FIG. 5 however showing the pipe clamping mechanism for down the hole hammer drilling of one embodiment of the present invention.

By removing the pins 27 the jaws and jaw holders can be removed from the clamp lever arms 20 and a hammer drill pipe slips table 28 as shown in FIG. 6 can then be fitted onto the base frame 15 when the lever arms 20 are in their raised position.

The drilling rig of the present invention, as can be seen, provides rod clamps which in the case of diamond drilling are self-energizing to securely hold the pipe and which can be simply modified to take a slips table when the drilling rig is needed for down the hold hammer drilling.

Figure 7:
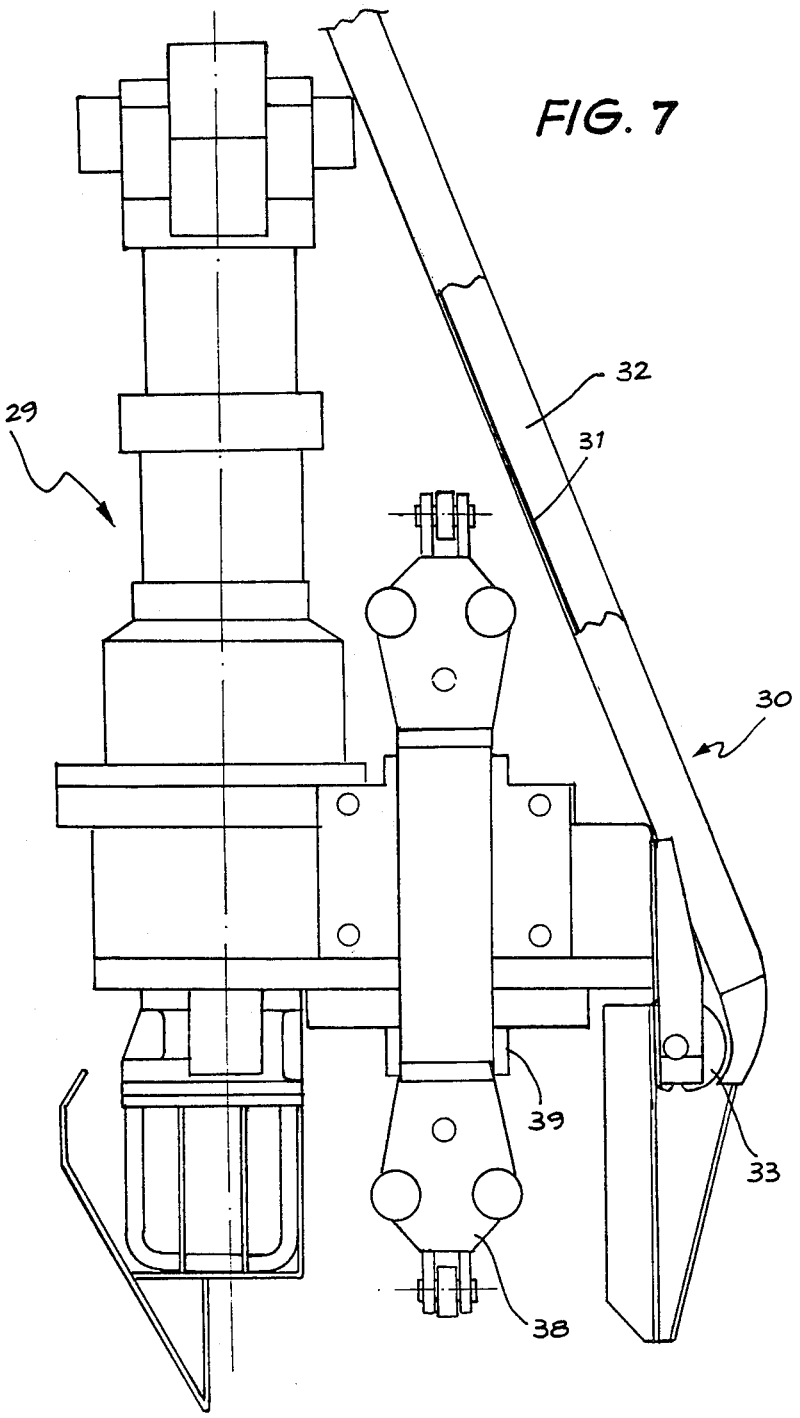
FIG. 7 is a view of the rotation head of one embodiment of the present invention in its normal drilling position with the mast structure removed for clarity.
Figure 8:
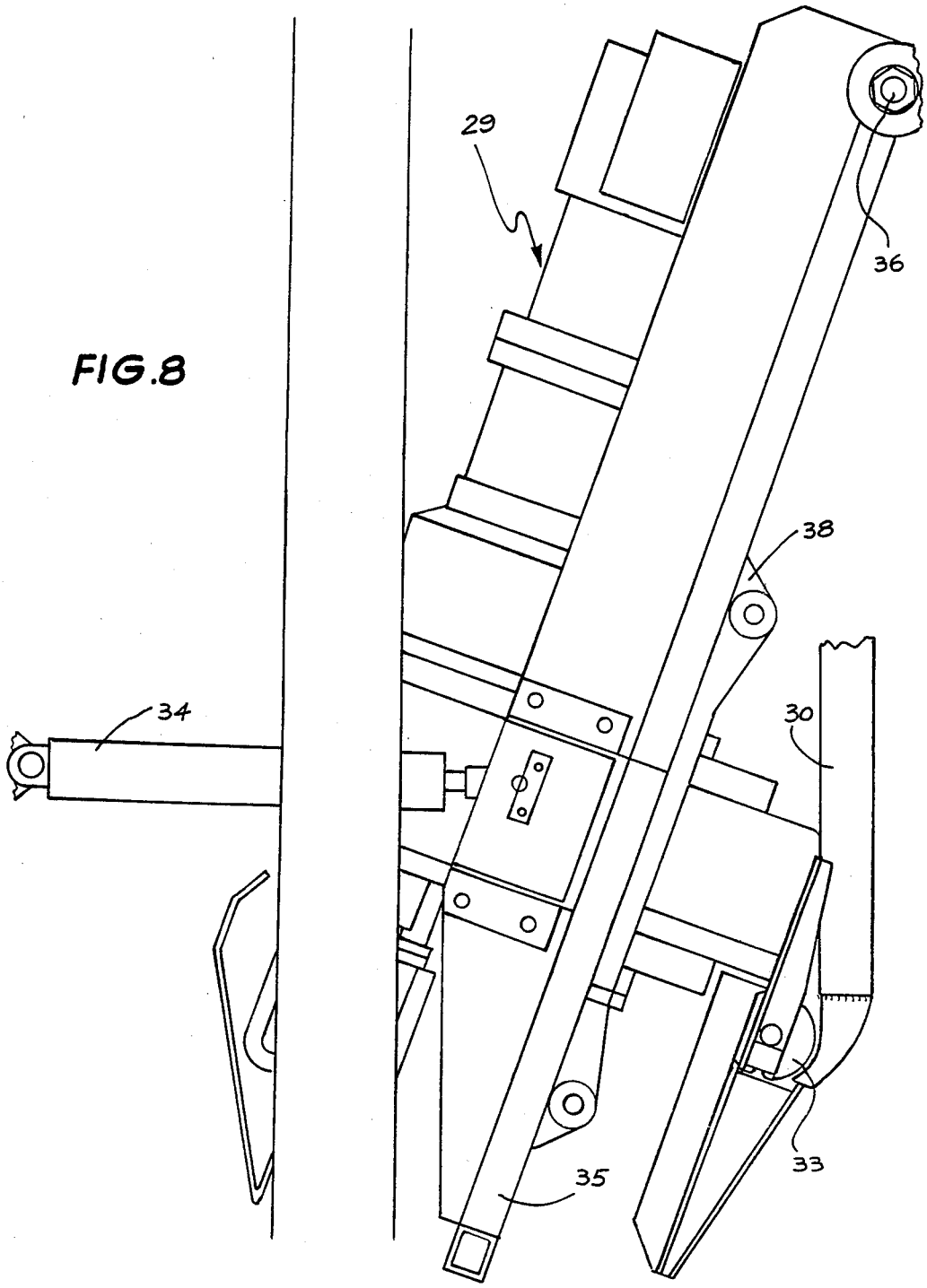
FIG. 8 is a view of the rotation head of FIG. 7 in its racked back position.
Figure 9:
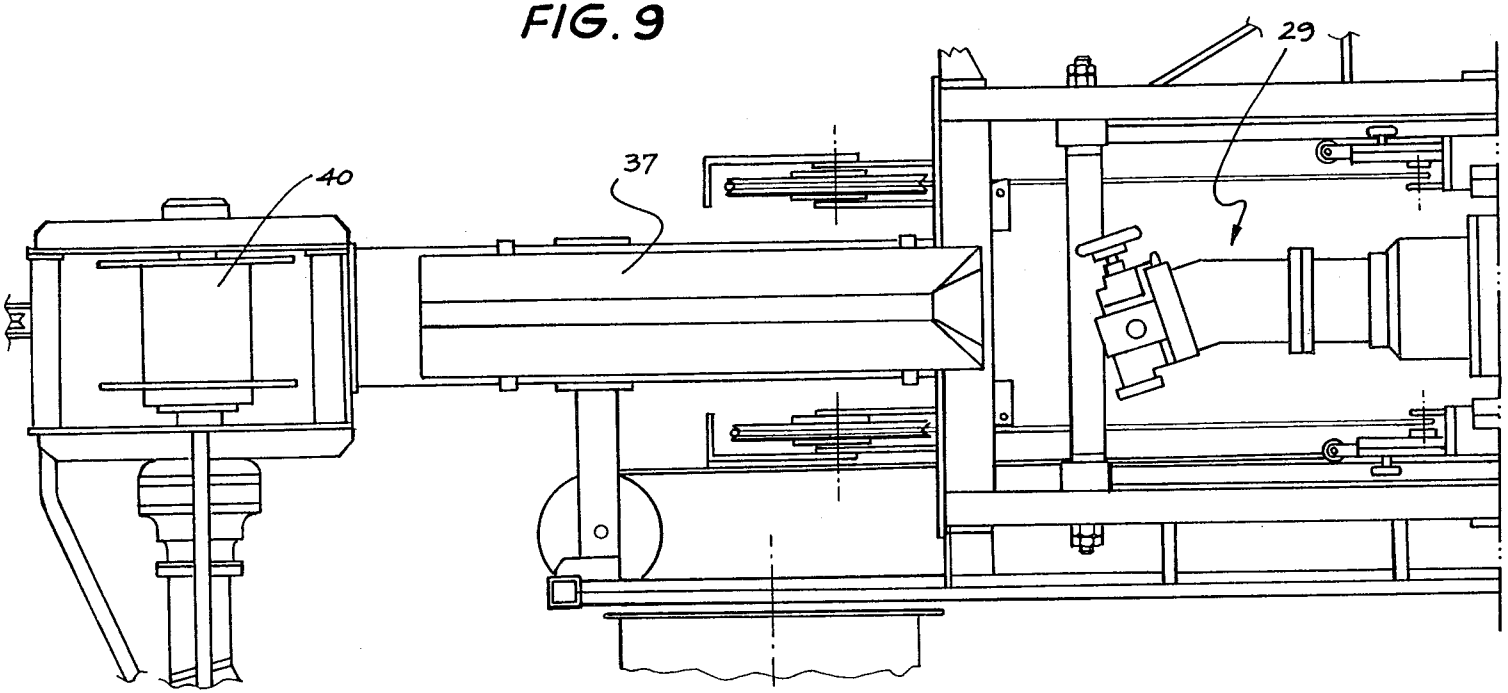
FIG. 9 illustrates the main hoist located at the top of the mast.

The rotation head 29, shown in FIGS. 7–9, of the present invention comprises an axial piston motor having a safe speed range from 100 to 3,500 revs per minute. The speed being infinitely variable over the entire range. The output spindle has a safe speed range of from 33 to 1,160 R.P.M. and as such the main spur gears in the main gear box are always engaged and have a reduction ration of 3:1.

The planetary drive can either be in high, resulting in a direct drive from the axial piston motor output shaft to the pinion of the main spur gears, or it can be put in low resulting in a 4:1 reduction. With the planetary in the low the total rotation head reduction ratio is 12:1 resulting in the speed range of from 8 to 292 revs. per minute at the output spindle of the rotation head. With the planetary in high the total reduction ratio is 3:1 resulting in the speed range of 33 to 1,160 revs. per minute.

The construction of the rotating head, utilizing planetary gears and hydraulics, allows for a vary compact rotation head when compared with conventional rotation heads, and allows the rotation head to be racked back between the masts thus leaving the path clear for the main winch rope from the main winch drum through to the centre of the rod clamps.

Connected to the rotation head are runner supports 38 which run along tracks on the front mast members 16. Between the runner supports is located the output drive of the main spur gears 39.

The rotation head 29 is shown in FIG. 7 in its normal drilling position parallel to the axis of the drill shaft. (For the sake of clarity the mast frame work and tracks have been removed.) The rotation head 29 is fitted with a rod slide 30. The rod slide 30 comprises a flat base section 31 with two upward projecting sides 32. Located at the downward end of the rod slide is a deflector roller 33.

When the rotation head is in its working position the rod slide extends at an angle to the drilling axis of the shaft. However, when the rotation head 29 is racked back as shown in FIG. 8 the rod slide 30 lines up with the axis of the drill shaft such that the main winch rope from the main winch drum runs clear of the rod slide with the rod slide being parallel with the drill string. The racking back is operated by the cylinder 34 connected between the mast and the rack back cradle 35 when the rotational head 29 is raised to the top of the mast such that it is positioned within the rack back cradle 35. The rotation head assembly in the cradle 35 pivots on the pivot point 36 on the main front mast frame members 16 (see FIG. 9). Located along the mast section is a plug slide (not shown). By means of a small hydraulic jack and associated linkage arms the slide can be jacked into any position within its range of travel whereby the sliding surface of the slide remains always parallel to the axis of the drill string. This feature is particularly important when, during the angle drilling, heavy drill pipes have to be hoisted into the hole. The plug slide can be so positioned that the drill pipe, to be hoisted and then lowered down into the hole, will be in line with the rod clamp centre and hence with the drill hole.

When the plug slide is jacked out and the rotation head is racked back the hoisting plug and drill rods are now supported along almost the entire length of the mast by the fixed top plug slide 37 (FIG. 9), the rod slide 30 and the jack-out plug slide. The jackout plug slide is located along the mast section such that during normal operations it is out of the way of the rotation head yet it is able to be jacked into a supporting position to support any diameter drill pipe.

The main hoist 40 as shown in FIGS. 9 and 1 is mounted on the top of the mast, which compared with conventional drill rigs, with a hoist on deck, halves the load reaction on the mast top when lifting the drill string. The top of the mast position also eliminates the need for supporting sheaves. The prime mover of the hoist is a high pressure controlled axial piston motor which automatically senses and adjusts to maximum possible speed i.e. the product of the speed and load is kept constant which means that the smaller the load the greater the hoisting speed.

As therefore can be seen the present invention provides a versatile mobile drilling rig which has distinct advantages over the mobile drilling rigs of the prior art.

It should be obvious to people skilled in the art that modifications could be made to the drilling rig as illustrated without departing from the scope or spirit of the present invention.

We claim:

1. A mobile drill rig comprising:

a mast having a pair of forward and rear mast members connected to each other;

a base frame located at the lower extremities of said mast members;

a rotation head comprising a variable speed axial piston motor;

a main gear box connected to the output of said piston motor;

a planetary drive adapted to be connected to the input of the main gear box, said rotation head being mounted directly between the mast members for axial movement along the mast members, with the drill line located between the pair of forward mast members; and a cradle located at the top of the mast such that the rotation head can move along said mast members into said cradle, said cradle being pivotally connected to said mast members so as to be pivotal about a horizontal axis so that with the rotation head within said cradle the cradle is adapted to be pivoted to move the rotation head further back between the mast members to move the rotation head clear of the drill line.

2. A drill rig according to claim 1, wherein the rotation head has a drill slide connected thereto, which when said rotation head is pivoted back between the mast members clear of the drill string the rod slide is parallel to and adjacent the drill string.

3. A drill rig according to claim 1 wherein said mast is adapted to be connected to a fixed frame such that it is able to pivot about two axes, a lower axis and an upper axis, on said frame; rotation about the lower axis placing the mast in its angle drilling position and rotation about the upper axis placing the mast in its travel position, substantially parallel to the ground, further comprising a pivotal frame, hinged about said lower axis, and which contains the upper pivot axis, said mast being pivotally connected to an upper pivot axis, wherein first affixing means are provided which connect the pivotal frame to said fixed frame and second affixing means are provided which affix the mast to the pivotal frame between the upper and lower pivot axes, such that with the lower affixing means in place and the upper affixing means not affixed the mast can pivot about the lower axis, while with the upper affixing means in place and the lower not affixed, the mast can pivot about the upper axis.

4. A drill rig according to claim 1 comprising a drill shaft connected to said rotation head wherein the base frame is adapted to contain a set of clamps to hold the drill shaft in position, said clamps bearing on a tapered surface of the base frame such that the weight of the drill shaft urges said clamps to slide down the tapered surface and hence exert a locking pressure on said drill shaft.

5. A drill rig according to claim 4 wherein the clamp can be removed and a hammer drill pipe slips table can be fitted onto the base frame.

* * * * *